US006836907B1

(12) United States Patent
Pesta

(10) Patent No.: US 6,836,907 B1
(45) Date of Patent: Jan. 4, 2005

(54) LIGHTWEIGHT SOLID SAFETY SWIMMING POOL COVERS

(75) Inventor: LeeAnn Pesta, West Babylon, NY (US)

(73) Assignee: Pool Cover Corporation, Hauppauge, NY (US)

( * ) Notice: Subject to any disclaimer, the term of this patent is extended or adjusted under 35 U.S.C. 154(b) by 0 days.

(21) Appl. No.: 10/761,467

(22) Filed: Jan. 21, 2004

(51) Int. Cl.[7] ..... E04H 4/00

(52) U.S. Cl. ..... 4/498; 4/503; 160/378; 139/383 R; 428/109

(58) Field of Search ..... 4/498, 500, 502, 4/503; 160/378; 139/383 R, 420 A; 156/244.25; 428/108–110

(56) References Cited

U.S. PATENT DOCUMENTS

| | | | | | |
|---|---|---|---|---|---|
| 2,619,705 | A | * | 12/1952 | Foster | 139/383 R |
| 2,958,872 | A | * | 11/1960 | Meyer, Jr. | 4/503 |
| 3,593,757 | A | * | 7/1971 | Haynes | 4/498 |
| 3,762,983 | A | * | 10/1973 | Osborn | 156/244.25 |
| 4,122,561 | A | | 10/1978 | Barr | 4/172.12 |
| 4,203,174 | A | | 5/1980 | Schults | 4/172 |
| 4,262,373 | A | | 4/1981 | Chambers | 4/502 |
| 4,459,711 | A | * | 7/1984 | Sartain et al. | 4/502 |
| 4,708,080 | A | | 11/1987 | Conrad | 4/498 |
| 4,972,529 | A | | 11/1990 | Wolfson, Jr. | 4/500 |
| 5,025,513 | A | * | 6/1991 | Weissner | 4/498 |
| 5,546,615 | A | | 8/1996 | Chamness | 4/503 |
| 5,920,922 | A | | 7/1999 | Ragsdale et al. | 4/502 |
| 6,047,415 | A | | 4/2000 | Brown | 4/498 |
| 2002/0116756 | A1 | | 8/2002 | Martin et al. | 4/502 |

* cited by examiner

*Primary Examiner*—Tuan Nguyen
(74) *Attorney, Agent, or Firm*—Alfred M. Walker

(57) ABSTRACT

A solid mesh swimming pool cover incorporates a mesh layer that has been successfully used as a porous mesh cover for several years with a thin impermeable base layer. A two-step polymer coating process seals the mesh to produce a solid safety swimming pool cover of unusual light weight and durability with an abrasion resistant bottom layer that has a low coefficient of friction to facilitate easy removal. The base layer is a plastic or resin product, such as a co-polymer resin, and the top layer is a mesh pool cover fabric, such as polypropylene. Ultraviolet (UV) inhibitors added to both coating step materials insure an extended service life. Since the mesh used for the centrally located mesh panels in the drain type solid cover of this invention uses the same mesh as the rest of the non-porous cover, it is more aesthetically pleasing since it blends in with the rest of the cover.

22 Claims, 2 Drawing Sheets

LIGHTWEIGHT SOLID SAFETY SWIMMING POOL COVERS

FIELD OF THE INVENTION

The present invention relates to a combination thin, solid and mesh, pool cover.

BACKGROUND OF THE INVENTION

Swimming pool covers for off-season use are available in two distinct varieties. One is a mesh construction, which lets rain and melting snow drain right through while providing safety and preventing large debris from entering the pool. The other type of pool cover is a solid vinyl safety cover, which is impervious to water. The solid vinyl covers are typically significantly heavier and therefore more difficult to roll or fold for removal. They also tend to drag on the pool decking and to catch on any irregularities.

The solid vinyl pool covers do have some advantages; they prevent most of the sunlight from penetrating thereby preventing the growth of some types of algae in the water below. They can also prevent the draining of contaminated water with fine debris and bacteria into the pool.

Actually, two types of solid vinyl pool covers are in common use. The type with centrally located drain panels, while not precluding contaminated water from entering the pool, still block UV rays from sunlight. The second type that is totally solid vinyl must be used with a weighted pump on the surface that automatically removes any standing water from the top surface; this prevents any contaminated water from entering the pool.

Existing swimming pool covers are usually either lightweight, open mesh covers, or heavy solid plastic or rubber pool covers, each having its own disadvantages.

For example, open mesh pool covers are lightweight, but since they have an open mesh, they allow rain and small organic particles to traverse the cover, thereby introducing excess rainwater or undesirable organic matter into the pool, requiring cleaning. On the other hand, solid pool covers are heavy to handle and remove.

What is lacking is a pool cover, which combines the lightweight feature of the mesh pool cover, while providing the impermeability of a solid pool cover.

Among related patent references include U.S. Patent Publication No. 2002/0116756 of Martin, which discloses a swimming pool cover comprised of a flexible fabric sheet having a mesh construction underside. However, the mesh is on the underside of the pool cover to reduce contact with the underside of the pool cover against the upper surface of the pool deck. Therefore, the mesh has to be distinctly three dimensional in the downward vertical direction, to isolate the solid upper pool cover fabric layer 24 away above the pool deck. As a result, the Martin cover is not like the thin dual ply pool cover of the present invention, with a mesh on the upper side, not the underside.

U.S. Pat. No. 4,122,561 of Barr discloses a pool cover of non-porous, flexible sheet material. Reinforced polyvinylchloride is preferred, wherein the reinforcing consists of mesh polyester cord between upper and lower layers of the polyvinylchloride.

U.S. Pat. No. 4,972,529 of Wolfson discloses a heavy duty protective blanket for pool covers having at least one intermediate layer of plastic mesh to provide structural integrity and durability. The upper UV resistant layer is described as being a polypropylene over the mesh, which is sandwiched between the upper layer and a lower polypropylene layer.

U.S. Pat. No. 5,920,922 of Ragsdale discloses a pool cover system wherein the cover is made from any suitable fabric including, preferably, a 16-ounce vinyl material reinforced with a strong polyester mesh to increase strength and tear resistance.

U.S. Pat. No. 5,546,615 of Chamness describes a pool cover of upper and lower sheets of 30 mil HDPE plastic surrounding a polystyrene insulation.

U.S. Pat. No. 4,262,373 of Chambers discloses a vinyl pool cover 41, which is reinforced with mesh.

U.S. Pat. No. 4,203,174 of Shults discloses a machine washable pool cover tarp 30 of laminar plastic, such as vinyl, which is reinforced with a tightly woven DACRON® mesh.

U.S. Pat. No. 3,762,983 of Osborn discloses a mesh material in general which is enclosed in a plastic film, such as low density polyethylene or a flexible ethylene copolymer. Unlike the prior patents which are mesh-reinforced upper and lower plastic films, in Osborn '983 the mesh itself is of strands having diameters of between 10–30 mils, preferably 12–24 mils, in thickness. The mesh strands are completely enclosed within the plastic film, as shown in FIG. 2, so that the mesh strands 13 are completely enclosed on all sides by the plastic film 12, making the overall thickness of the pool cover much thicker than the mesh strands themselves.

U.S. Pat. No. 3,593,757 of Haynes discloses a rip-resistant open weave woven pool cover.

Furthermore, U.S. Pat. No. 6,047,415 of Brown describes an algae-resistant pool cover, which floats on the pool water. Additionally, U.S. Pat. No. 4,708,080 of Conrad describes a woven material akin to a mesh, backed by a plastic laminate, such as, for example, MYLAR® or other plastics.

OBJECTS OF THE INVENTION

It is therefore an object of the present invention to provide a novel swimming pool cover, which is both lightweight and impermeable, such as with a mesh-reinforced upper layer and a thin, solid lower layer.

It is also an object of the present invention to provide a swimming pool cover which has the benefits of mobility to be moved easily, being lightweight and with strong durability.

Other objects which become apparent from the following description of the present invention.

SUMMARY OF THE INVENTION

In keeping with these objects and others, which may become apparent, the pool cover of this invention has proven strength because it incorporates a mesh layer that has been successfully used as a porous mesh cover for several years. In addition, a two-step polymer coating process seals the mesh to produce a solid safety swimming pool cover of unusual light weight and durability with an abrasion resistant bottom layer that has a low coefficient of friction to facilitate easy removal.

The base layer is a plastic or resin product, such as a copolymer resin, and the top layer is a mesh pool cover fabric, such as polypropylene.

UV inhibitors added to both coating step materials insure an extended service life. Since the mesh used for the centrally located mesh panels in the drain type solid cover of this invention uses the same mesh as the rest of the non-porous cover, it is more aesthetically pleasing since it blends in with the rest of the cover.

Therefore, in a preferred embodiment, the swimming pool cover includes a layer of a lightweight mesh of woven strands, which are coated with a plastic material, which penetrates the mesh and seals openings in the mesh. A bottom layer of low density, solid plastic material is attached to the layer of mesh.

Reinforcing webs are displayed in an orthogonal pattern on a top surface of the layer of mesh, extending from the cover, which is attached to a perimeter of a swimming pool, so that the lightweight solid cover completely covers the pool.

The mesh is preferably made up of extruded strands of polypropylene or a similar material, and the coating plastic material is transparent or translucent, optionally being ethyl methyl acrylate, or other similar material, with an ultraviolet (UV) light inhibitor.

The bottom layer of the swimming pool cover is preferably a solid black sheet of plastic, also with an ultraviolet (UV) light inhibitor. Preferably the sheet of plastic is a low density polyethylene or other similar material.

Aesthetically, the fibers of the reinforcing webs in the warp and weft directions of the swimming pool cover are optionally in contrasting colors, to preferably form a distinctive pattern to improve the aesthetic appearance of the cover.

The swimming pool cover is preferably produced by permeating a layer of the light mesh of woven strands with a transparent or translucent plastic material, to seal openings in the mesh, and adding to the mesh layer, a bottom layer of low density, solid plastic material. The top surface of the mesh reinforcing webs are provided in an orthogonal pattern, and the pool cover is attached to a perimeter of the pool, to cover the pool.

Although other thicknesses may apply, preferably the thickness of the swimming pool cover is between 14 and 15 mils, with a preferable weight of 8.5–9.0 ounces per square yard. The pool cover of the present invention is used instead of a typical solid vinyl pool cover material, weighing typically about at about 12–13 ounces or more per square yard. The thickness and weight of the pool cover of the present invention enable the pool cover to be both lightweight and durable.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
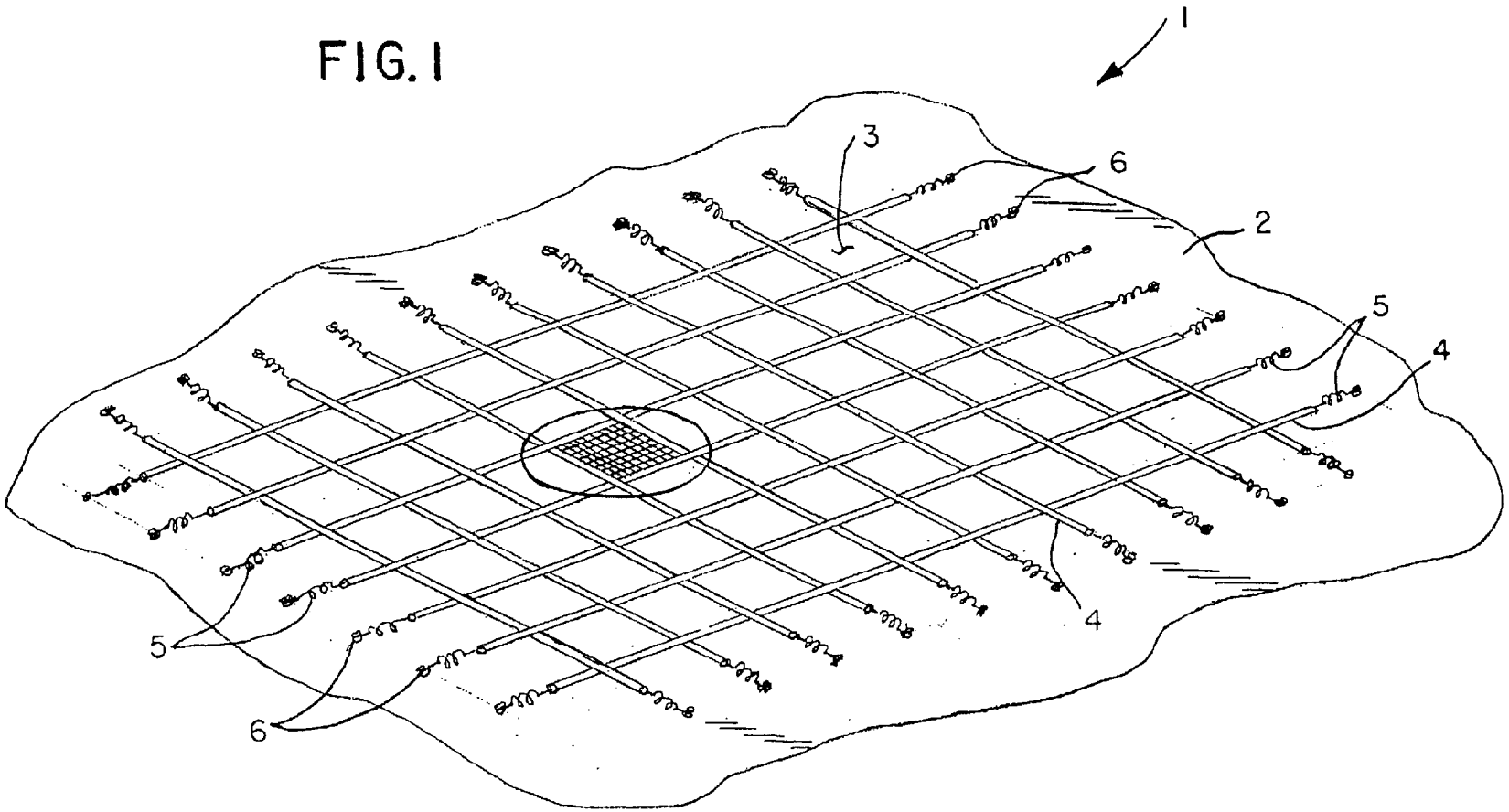
FIG. 1 is a Perspective view of a solid pool cover of this invention with an ellipse showing a portion of the weave patterns thereof.

FIG. 1 shows a perspective view of the solid pool cover 1 of this invention installed over a pool. Reinforcing webs 4 are sewn in an orthogonal pattern and extend beyond the periphery to become attachment straps for retaining springs 5 which are secured by recessed anchors 6 which are embedded in deck 2.

FIG. 1 can represent either a totally solid or drain panel solid swimming pool cover of this invention since there would be very little visual difference between them. Fabric 3 has the visible mesh layer on top.

Figure 2:
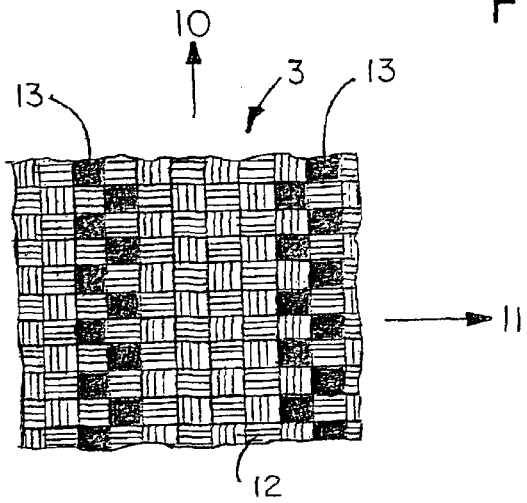
FIG. 2 is a Top plan view of a weave pattern detail of the solid pool cover of this invention, taken within the ellipse shown in FIG. 1, as a typical representation of a weave pattern of the entire solid pool cover shown in FIG. 1.

FIG. 2 shows a weave detail of cover fabric 3 top view with warp direction 10 and weft direction 11 (orthogonal to it) indicated. Fibers in a background color 12 are used for most of the pattern, but warp strands 13 of a contrasting color are used to form a distinctive fanciful, decorative visual pattern if desired. The aesthetic aspects of a visible top woven layer are far more appealing than the drab solid opaque look of the typical solid pool cover.

Figure 3:
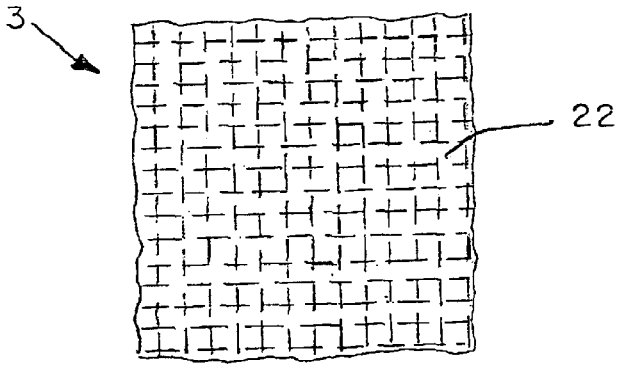
FIG. 3 is a Bottom view detail of the solid pool cover of this invention; and, FIG. 4 is a Crossectional view in the warp direction showing the construction of the pool cover material of this invention.

FIG. 3 shows the back side of the same detail patch of material of FIG. 2. The back side is dark, preferably a solid black shiny material with the weave pattern barely visible.

The pool cover material 3 process is first started as a mesh woven of extruded polypropylene strands. Next, the mesh is preferably coated with ethyl methyl acrylate with a UV inhibitor. This penetrates the mesh and seals the openings; it also provides toughness and bond adhesion strength. This layer is transparent or translucent, and does not detract from the appearance of the mesh, which optionally is provided in a fanciful visual pattern.

This first coating layer is applied at about 150 grams/square meter. The bottom layer is then applied. It is a dark, preferably black low density polyethylene (LDPE) with UV inhibitor. This results in a light weight very strong fabric 3 with a low friction underside that is impervious to water. In fact, the weight of the pool cover material of this invention is preferably 8.5–9.0 ounces per square yard; this replaces the previous solid vinyl pool cover material of the same manufacturer which weighed in at 12–13 ounces or more per square yard (nylon scrim in a vinyl laminate).

Figure 4:
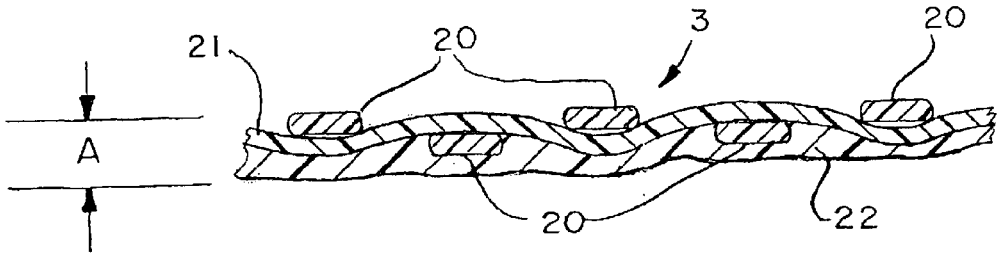

FIG. 4 is an enlarged crossection of solid pool cover material 3. The first coating of ethyl methyl acrylate is not shown for clarity. The warp strands 20 are shown in crossection. Weft strand 21 is shown across with opaque bottom LDPE layer 22 attached to the bottom of the previously coated mesh layer. The thickness of the finished fabric 3, dimension A, is preferably between 14 and 15 mils.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A swimming pool-cover comprising:

a layer of a light weight mesh of woven strands;

said layer of mesh being coated with a plastic material which penetrates said mesh and seals openings in said mesh;

a bottom layer of low density, solid plastic material attached to said layer of mesh; and reinforcing webs in orthogonal pattern on a top surface of said layer of mesh extending from said cover for attachment to a perimeter of said pool so that said cover completely covers said pool.

2. The swimming pool cover of claim 1 in which said mesh is made up of extruded strands of polypropylene.

3. The swimming pool cover of claim 2 in which the coating plastic material is transparent.

4. The swimming pool cover of claim 2 in which the coating plastic material is translucent.

5. The swimming pool cover of claim 2 in which the coating plastic material is ethyl methyl acrylate with a UV inhibitor.

6. The swimming pool cover of claim 1 in which the bottom layer is a solid black sheet of plastic with a UV inhibitor.

7. The swimming pool cover of claim 6 in which the sheet of plastic is a low density polyethylene.

8. The swimming pool cover of claim 1 in which fibers of the reinforcing webs in the warp and weft directions are in contrasting colors to form a distinctive pattern to improve the esthetic appearance of said cover.

9. The method of making a swimming pool cover comprising the steps of:

permeating a layer of a light mesh of woven strands with a plastic material to seal openings in said mesh;

adding to the layer of said mesh a bottom layer of low density, solid plastic material; and adding to a top surface of said mesh reinforcing webs in orthogonal pattern for attachment to a perimeter of said pool for covering said pool.

10. The method of claim 9 in which said mesh is made up of extruded strands of polypropylene.

11. The method of claim 9 in which the permeating plastic material is transparent.

12. The method of claim 9 in which the permeating plastic material is translucent.

13. The method of claim 9 in which the permeating plastic material is ethyl methyl acrylate with a UV inhibitor.

14. The method of claim 9 in which the bottom layer is a sheet of black plastic with a UV inhibitor.

15. The method of claim 9 in which the sheet of plastic is a low density polyethylene.

16. The method of making a decorative swimming pool cover comprising the steps of:

providing a layer of mesh of woven strands in a fanciful visual pattern;

permeating said layer of a light mesh of woven strands with a plastic material to seal openings in said mesh;

adding to the layer of said mesh a bottom layer of low density, solid plastic material; and adding to a top surface of said mesh reinforcing webs in orthogonal pattern for attachment to a perimeter of said pool for covering said pool.

17. The method of claim 16 in which said mesh is made up of extruded strands of polypropylene.

18. The method of claim 16 in which the permeating plastic material is transparent.

19. The method of claim 16 in which the permeating plastic material is translucent.

20. The method of claim 16 in which the permeating plastic material is ethyl methyl acrylate with a UV inhibitor.

21. The method of claim 16 in which the bottom layer is a sheet of black plastic with a UV inhibitor.

22. The method of claim 16 in which the sheet of plastic is a low density polyethylene.

* * * * *